US010370158B2

(12) United States Patent
Herlin et al.

(10) Patent No.: US 10,370,158 B2
(45) Date of Patent: Aug. 6, 2019

(54) CONTAINER WITH DISPLAY FUNCTION

(71) Applicant: Å&R Carton Lund Aktiebolag, Lund (SE)

(72) Inventors: Henrik Herlin, Kristianstad (SE); Simon Holka, Staffanstorp (SE); Eva Sunning, Lund (SE)

(73) Assignee: Å&R Carton Lund Aktiebolag (SE)

( * ) Notice: Subject to any disclaimer, the term of this patent is extended or adjusted under 35 U.S.C. 154(b) by 178 days.

(21) Appl. No.: 15/523,851

(22) PCT Filed: Nov. 2, 2015

(86) PCT No.: PCT/SE2015/051149
§ 371 (c)(1),
(2) Date: May 2, 2017

(87) PCT Pub. No.: WO2016/072911
PCT Pub. Date: May 12, 2016

(65) Prior Publication Data

US 2017/0327279 A1 Nov. 16, 2017

(30) Foreign Application Priority Data

Nov. 3, 2014 (SE) ..... 1451307

(51) Int. Cl.
*B65D 8/00* (2006.01)
*B65D 21/02* (2006.01)
(Continued)

(52) U.S. Cl.
CPC ..... *B65D 43/02* (2013.01); *B65D 15/14* (2013.01); *B65D 21/0219* (2013.01);
(Continued)

(58) Field of Classification Search
CPC ..... B65D 43/02; B65D 43/16; B65D 15/14; B65D 51/245; B65D 51/20; B65D 43/169;
(Continued)

(56) References Cited

U.S. PATENT DOCUMENTS 999,374 A * 8/1911 Klugel ..... 220/254.3
4,154,360 A 5/1979 Smith
(Continued)

FOREIGN PATENT DOCUMENTS

CN 101272961 A 9/2008
CN 202038495 U 11/2011
(Continued)

OTHER PUBLICATIONS

First Chinese Office Action including Search Report for CN201580068708.3 dated May 30, 2018.
(Continued)

*Primary Examiner* — James N Smalley
(74) *Attorney, Agent, or Firm* — Lerner, David, Littenberg, Krumholz & Mentlik, LLP

(57) ABSTRACT

The present invention provides a packaging container for bulk solids, the container comprising a container body and a container lid. The container body includes wall portions that define a container opening. The lid comprises an upper outer lid surface which includes a slanted lid surface. The upper outer lid surface and the slanted lid surface each having a projected surface in the plane of the container opening. The projected surface of the slanted lid surface constitutes from 40% to 100%, 50% to 90%, or 60% to 80% of the projected surface of the upper outer lid surface. The slanted lid surface is slanted such that when the lid is in a closed position at the container opening, a front end edge of the slanted lid surface is located lower in the height direction
(Continued)

of the container than a rear end edge of the slanted lid surface.

16 Claims, 6 Drawing Sheets

(51) Int. Cl.
*B65D 43/02* (2006.01)
*B65D 43/16* (2006.01)
*B65D 51/20* (2006.01)
*B65D 51/24* (2006.01)

(52) U.S. Cl.
CPC ..... *B65D 43/16* (2013.01); *B65D 43/169* (2013.01); *B65D 51/20* (2013.01); *B65D 51/245* (2013.01); *B65D 2251/0018* (2013.01); *B65D 2251/0021* (2013.01); *B65D 2251/0093* (2013.01); *B65D 2251/1008* (2013.01); *B65D 2543/00027* (2013.01); *B65D 2543/00351* (2013.01); *B65D 2543/00388* (2013.01)

(58) Field of Classification Search
CPC ..... B65D 21/0219; B65D 2251/1008; B65D 2543/00388; B65D 2543/00351; B65D 2251/0021; B65D 2251/0018; B65D 2251/0093
USPC ..... 220/254.3, 380
See application file for complete search history.

(56) References Cited

U.S. PATENT DOCUMENTS

| | | | | |
|---|---|---|---|---|
| 4,260,069 | A | 4/1981 | Juergens | |
| 6,419,112 | B1 | 7/2002 | Bruce et al. | |
| 6,761,279 | B1 * | 7/2004 | Martin | B65D 43/169 220/254.3 |
| 2001/0035424 | A1 | 11/2001 | Combe et al. | |
| 2004/0238553 | A1 | 12/2004 | Lane et al. | |
| 2007/0068891 | A1 * | 3/2007 | Rathbone | B65D 43/161 215/235 |
| 2007/0196542 | A1 | 8/2007 | Rathbone et al. | |
| 2008/0190927 | A1 | 8/2008 | Bougoulas et al. | |
| 2010/0236966 | A1 * | 9/2010 | Luttik | B65D 21/022 206/508 |
| 2012/0074158 | A1 | 3/2012 | Lafleur | |
| 2014/0305819 | A1 | 10/2014 | Hill et al. | |

FOREIGN PATENT DOCUMENTS

| | | | |
|---|---|---|---|
| CN | 203392148 | U | 1/2014 |
| DE | 2829153 | A1 | 1/1980 |
| EP | 0006652 | A1 | 1/1980 |
| EP | 0294781 | A1 | 12/1988 |
| EP | 0312513 | A2 | 4/1989 |
| EP | 0370982 | A1 | 5/1990 |
| EP | 1092647 | A2 | 4/2001 |
| EP | 1864914 | A1 | 12/2007 |
| EP | 2716551 | A1 | 4/2014 |
| JP | 2004307054 | A | 11/2004 |

OTHER PUBLICATIONS

International Search Report for PCT/SE2015/051149 dated Apr. 1, 2016.
Partial International Search for ITS/SE14/00238 dated Jun. 3, 2015.
Extended European Search Report for EP 15 85 7693 dated May 18, 2018, 6 pages.

* cited by examiner

CONTAINER WITH DISPLAY FUNCTION

CROSS-REFERENCE TO RELATED APPLICATIONS

The present application is a national phase entry under 35 U.S.C. § 371 of International Application No. PCT/SE2015/051149 filed Nov. 2, 2015, published in English which claims priority from Swedish Application No. 1451307-1 (SE), filed Nov. 3, 2014, all of which are incorporated herein by reference.

TECHNICAL FIELD

The invention pertains to a packaging container for bulk solids, such as tobacco or granulated or pulverulent foodstuffs. The container is of the kind comprising a container body formed by container walls including a front wall, a rear wall and two side walls, the container walls extending from a container bottom to a container opening in a height direction of the container and being of equal height as measured from the container bottom to the container opening. The container body has an opening edge at the container opening, which opening edge extends in a plane which is perpendicular to the height direction of the container, and the container comprises a lid for closing the container opening.

BACKGROUND

In the area of packaging of consumer goods, and in particular consumer goods which is packaged in relatively rigid packaging containers which serve as protective transport and storage containers at the retail end and as storage and dispensing containers at the consumer end, the different functions of the containers may result in conflicting demands on the packaging design. At the retail end there is a desire that the packaging containers allow efficient and space-saving transport and storage and preferably that they are stackable. However, when placed on a shelf in a shop, the packaging containers should preferably also have a display function and convey information to a prospective consumer about the contents in the package and its commercial origin. It may also be of importance to the manufacturer of the packaged goods and to the shop keeper that the packaging container has a distinctive design with high consumer appeal. The consumer may want a package that does not take up unnecessary space in a cupboard or on a shelf or counter-top but which has a design which makes the packaging container easily identifiable and appealing. It is also important to the consumer that the packaging container can be repeatedly opened to access the contents and be re-sealed to allow hygienic storage of the contents in the package between dispensing occasions.

Hence, there remains a need for a packaging container for consumer gods in the form of bulk solids, which container to a higher degree than for previous containers meets the different and sometimes conflicting demands on such packaging containers during packaging, transport, storage, selling and use by a consumer.

SUMMARY OF THE INVENTION

An object of the invention as disclosed herein, is to provide a packaging container which is better suited to meet the different demands on such packaging containers during manufacture, transport, storage, sale and use.

According to the invention, there is offered a packaging container for bulk solids. The container comprises a container body formed by a container wall comprising a front wall portion, a rear wall portion and two side wall portions. The container wall extends from a container bottom to a container opening in a height direction of the container and has a height as measured from the container bottom to the container opening. The container body has an opening edge at the container opening extending in a plane which is perpendicular to the height direction of the container. The container further comprises a lid for closing the container opening, the lid having a front lid edge which is adapted to be positioned at a front edge portion of the container opening, a rear lid edge which is adapted to be positioned at a rear edge portion of the container opening, two side lid edges which are adapted to be positioned at corresponding side edge portions of the container opening and an upper outer lid surface being delimited by the lid edges. The upper outer lid surface comprises a slanted lid surface, the upper outer lid surface and the slanted lid surface each having a projected surface in the plane of the opening and the projected surface of the slanted lid surface constituting from 40% to 100% of the projected surface of the upper outer lid surface, such as from 50% to 90% of the projected surface of the upper outer lid surface, or from 60% to 80% of the projected surface of the upper outer lid surface, the slanted lid surface being slanted such that when the lid is in a closed position at the container opening, a front end edge of the slanted lid surface is located lower in the height direction of the container than a rear end edge of the slanted lid surface.

Accordingly, the slanted portion of the upper outer lid surface is slanted in a downward direction from the rear of the packaging container towards the front of the packaging container, implying that the lid has a greater thickness at the rear lid end than at the front lid end. The slanted lid surface on the packaging container provides the container with an increased display surface, especially when the packaging container is viewed from the front of the container. In addition, the slanted lid surface gives the packaging container a distinctive shape and appearance allowing a user to quickly and easily identify the packaging container visually or by touching it and to distinguish it from other packaging containers, e.g. on a shop shelf or when placed in a cupboard. Tactile identifiability may be a desired property in a packaging container for consumer goods which is used under conditions of poor visibility such as when preparing infant formula during night-time and wishing to avoid turning on the light.

The slanted lid surface on the packaging container as disclosed herein may be planar or generally planar. A planar or generally planar slanted surface may be preferred for displaying printed graphics such as printed information and/or decorative patterns, logotypes, etc. Such printed graphics may be applied directly to the outer lid surface or may be printed on a label which is attached to the outer lid surface.

Furthermore, the outer lid surface may have a decorative and/or informative relief pattern formed in the lid itself and may be provided with any useful combination of printed graphics and relief patterns.

The slanted lid surface of the packaging container as disclosed herein may be arranged at an angle of slant to the plane of the container opening of from 2° to 25°, such as from 3° to 20°, from 4° to 15° or from 5° to 10°.

The slant angle is preferably selected to be relatively small, so that the packaging container may be perceived as having a generally cuboid shape. A cuboid shape may be optimal for efficient transport and storage of the packaged goods. A small slant angle is also desirable for making the packaging containers as disclosed herein stackable.

The lid on the packaging container as disclosed herein may be made from any suitable material such as plastic, cardboard or metal. The lid may be wedge-shaped and may have an inner lid surface which is parallel to the plane of the container opening. The term "wedge-shaped" is intended to include lids having generally tapering shape but which may have portions deviating in shape from the overall wedge shape, e.g. by the lid being provided with closure members, stacking elements, decorative elements, etc. The wedge-shaped lid may have a triangular or generally triangular cross-section in a front-to-rear direction.

The lid as disclosed herein may comprise an outer lid part and an inner lid part, wherein the outer lid surface and the slanted lid surface are provided in the outer lid part. Accordingly, the outer lid part has a three-dimensional profile while the inner lid part may be planar or profiled, as found suitable. The outer and inner lid parts may be joined to each other to form an assembled lid in any suitable manner such as by mechanical fastening, by adhesive, or by welding. The outer and inner lid parts may be made from the same kind of material or from different materials. As a non-limiting example, the outer lid part may be made from plastic and the inner lid part may be made from cardboard or a different kind of plastic material.

A reinforcement grid may be arranged between the outer lid surface and the inner lid surface. The reinforcement grid may be an element which is formed separately and placed between the inner and outer lid surfaces when assembling the lid. Alternatively, the reinforcement grid may be formed integrally with the lid or with a part of the lid, e.g. in a plastic molding process such as in an injection molding process.

In the packaging container as disclosed herein, the front wall portion may be outwardly curved such that the container body has a generally D-shaped cross-section. A D-shaped cross-section with an outwardly curved front wall portion provides the packaging container with an enlarged surface for displaying visually detectable graphics, and other visually identifiable structures at the front of the container. Accordingly, an outwardly curved front wall portion may further enhance a front view display function of the container. The packaging container may preferably still have a generally cuboid shape with at least two planar container wall portions and preferably with both side wall portions and the rear wall portion being planar.

The packaging container as disclosed herein may be a paperboard container. Accordingly, at least the container body which is formed by the container wall may be made from paperboard.

The container bottom may be made from paperboard, plastic, metal, etc., as known in the art. The lid may e.g. be made from plastic or metal or may be made from paperboard or from a paperboard/plastic laminate. Plastic lids may be preferred as they can be made rigid, durable and water resistant, and as they can be produced by well-known production methods such as injection molding.

The packaging container as disclosed herein may be a gastight container and may comprise an inner peelable or openable sealing membrane forming a cross-sectional seal between an interior compartment in the container body and the container opening.

A separately formed rim may be applied to an end edge of the container body being located at the container opening. The edge rim may be a plastic rim, a paper rim or a metal rim, with plastic rims generally being preferred. The rim may extend around the full periphery of the container opening and may be affixed to the container body along the opening edge e.g. by adhesive.

The container lid may be arranged to engage with the edge rim or directly with the opening edge to form a closure on the container. The closure between the container lid and the edge rim or opening edge is preferably liquid tight and most preferably also gas tight or at least substantially gas tight. A tight closure between the container lid and the edge rim may be accomplished by mating contours on the lid and on the rim and may include snap-lock features such as interengaging ridges and tracks or protrusions and holes/cavities, etc.

The closure between the container lid and the container body may comprise or be provided by a locking arrangement comprising a first locking element arranged on the container body or on an edge rim and a second locking element arranged on the container lid. The first and second locking elements are mating locking elements, such as female/male locking elements including hooks and other protrusions which are arranged to interengage with ridges, hooks, tracks, holes, cavities, loops, etc. By way of example, a locking arrangement may be provided by a locking flap or clasp closure extending from the forward edge on the lid and comprising at least one locking element which can be fastened into or onto a corresponding locking element on the container body or on an edge rim attached at the container opening. The locking elements are preferably designed to allow repeated opening and closing of the locking arrangement. Manipulation of the locking arrangement may be facilitated by means of gripping devices such as finger grips, friction enhancing elements, etc.

The container lid may be provided as a separate component which can be completely removed when opening the container. Alternatively, the container lid may be attached to the container body or to an edge rim by means of a hinge. The hinge may be a live hinge, i.e. a bendable connection between the lid and the container body or upper plastic rim. A live hinge may be formed integral with the lid and/or with a plastic or metal edge rim or an upper edge portion of a container body or may be a separately formed element which is attached to the container lid and to the container body or an edge rim. Alternatively, the hinge may be a two-part hinge, with a first hinge part arranged on the container lid and a second hinge part arranged on the container body or on an edge rim.

The packaging container as disclosed herein may comprise mating stacking members for allowing two or more of the packaging container to be arranged in a stacked configuration. The mating stacking members are arranged at the container bottom and at the container opening. A stacking member or stacking members at the container opening may be arranged on the container lid and/or on an edge rim surrounding the opening in the packaging container. The container lids may be provided with mating stacking members arranged on the upper outer surface and on the inner lower surface of each lid, making the lids separately stackable before being applied to a packaging container, e.g. in a process for producing the packaging containers as disclosed herein.

A stacking member at the container opening may take the form of a peripheral ledge surrounding the slanted lid surface and being peripherally arranged on the lid or being arranged on an edge rim attached to the opening edge. When one container is stacked on top of another container, a bottom edge of the top container which extends downward from a container bottom plate in the height direction may rest on the peripheral ledge. The height of the bottom edge is adapted to the maximum height of the slanted lid surface above the peripheral ledge such that any portion of the slanted lid surface which protrudes upwards in the height direction from the peripheral ledge can be accommodated in the space created between the downwardly extending bottom edge and the container bottom plate.

As an alternative to a continuous or discontinuous ledge which surrounds the slanted lid surface, stacking members at the container opening may be provided as two or more support surfaces cooperating with corresponding stacking members at the bottom of the container. The stacking members at the bottom of the container may be in the form of a downwardly extending bottom edge as set out above or may be in the form of knobs or other protrusions providing a desired spacing between a container bottom plate and the peripheral ledge or other support surface on which the stacking member or members at the bottom of the container are resting when one container is stacked on top of another.

Consequently, even if a large portion or even a major portion of the upper outer surface of the container lid is slanted, the provision of stacking members as set out herein, makes it possible to arrange the packaging containers horizontally on top of each other in a stable manner.

Correspondingly, lids or lid components may be stackable in a similar way by the provision of a peripheral ledge on a first outer side of the lid or lid component which is arranged to cooperate with one or more stacking members at the opposite inner side of the lid or lid component which stacking member or stacking members act to create a distance to an inner lid surface and a space in which the slanted lid surface may be accommodated to create a stable and space efficient stack of lid or lid components.

The packaging container as disclosed herein may be a container for pulverulent or granulated consumer goods, including alimentary or consumable products such as formula, tea, coffee, cocoa, sugar, flour, tobacco, etc., as well as house-hold chemicals such as detergents and dishwasher powder. The pulverulent or granulated products which are suitable for packaging in the packaging containers as disclosed herein are flowable, which means that a desired amount of the product may be poured or scooped out of the packaging container.

The packaging container as disclosed herein may be a container for tobacco.

Definitions

As used herein, a paperboard packaging container is a packaging container wherein at least the container body is formed from paperboard sheet material. The paperboard container may be formed in any manner known in the art, e.g. by forming a container body by bending a paperboard sheet material into a tubular shape and longitudinally closing the tube by joining overlapping or abutting side edges of the sheet material. The joint between the side edges may be covered by a sealing strip. The container bottom may be formed from a separate bottom plate which is attached at one end of the container body tube or which may be formed by folding an end portion of the container body tube.

As used herein, a paperboard material is a sheet material predominantly made from cellulose fibers or paper fibers. The paperboard material may be a single ply or multi ply material and may be a laminate comprising one or more layers of other materials such as polymeric materials, metal foil, etc. The paperboard material may be coated, printed, embossed, etc. and may comprise fillers, pigments, binders and other additives as known in the art. The paperboard materials as disclosed herein may also be referred to as cardboard or carton materials.

As used herein, the term "bulk solids" refers to a pulverulent solid material, e.g. in the form of particles or powder. Bulk solids in the context of the present application may be digestible, such as infant formula, coffee, tea, rice, flour, sugar, cereals, soup powder, custard powder, or the like. Alternatively, the bulk solids may be non-digestible, such as tobacco, detergent, fertilizer, chemicals or the like.

By a pulverulent material as used herein is implied any material in the form of particles, granules, grinds, plant fragments, etc.

As used herein, the term "cuboid" refers to a polyhedron having rectangular or generally rectangular faces. A cuboid packaging container may have rounded or bevelled edges. Although individual structures of a cuboid packaging such as a lid, a rim, corner portions, locking members, etc. may cause the shape of the packaging container to deviate from a perfect rectangular cuboid, the overall impression of the container shape is that of a rectangular cuboid.

The container body of the packaging container as disclosed herein may have four main body wall portions; a front wall portion arranged opposite a rear wall portion and two opposing side wall portions extending between the front wall portion and the rear wall portion. The body wall portions are connected at corners or corner portions which may be formed between planar surfaces arranged at right angles to each other or may be curved or bevelled corner portions providing the packaging container with a softer, slightly rounded appearance. Moreover, the shape of the body wall portions may deviate from a planar shape, with one or more of the body wall portions having an outward or inward curvature. When the container body has one or more outwardly curved body wall portion the curvature of any such body wall portion is always lesser than the curvature of any curved corner portion, i.e. a radius of curvature of a corner portion in the container body of the packaging container as disclosed herein is always smaller than any radius of curvature of a body wall portion. A transition between a corner portion and a body wall portion may be seen as a distinct change in curvature or may be seen as a continuous change of curvature.

A slant angle, a, of the slanted lid surface is determined by drawing a line between the front end edge of the slanted lid surface and the rear end edge of the slanted lid surface and measuring the angle between the line and a plane parallel with the container opening.

The slanted lid surface may have any suitable shape such as circular, oval, square, rectangular, D-shaped, etc. The shape of the slanted lid surface may match the overall shape of the upper outer lid surface or may be different from the shape of the upper outer lid surface. The slanted lid surface may be symmetrically arranged on the upper outer lid surface or may be offset in relation to a centre line bisecting the upper outer lid surface in a direction from front to rear and/or be offset in relation to a centre line bisecting the upper outer lid surface in a direction from one side edge to the opposite side edge.

By an openable or peelable sealing membrane is meant a membrane that may be fully or partly removed by a user in order to provide access to an interior compartment of the packaging container either by breaking a seal between the sealing membrane and the inner surface of the container wall, or by tearing or otherwise breaking the sealing membrane itself.

A peelable or tearable sealing membrane may be gastight or gas-permeable. A gastight membrane may be manufactured from any material or material combination suitable for providing a gastight sealing of a compartment delimited by the sealing membrane, such as aluminium foil, silicon-coated paper, plastic film, or laminates thereof. A gastight membrane is advantageous when the bulk solids stored in the packaging container are sensitive to air and/or moisture, and it is desirable to avoid contact of the packaged bulk solids with ambient air.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of material are not necessarily drawn to scale. The packaging container, lids and lid component shown in the figures are provided as examples only and should not be considered limiting to the invention. Accordingly, the scope of the invention is determined solely by the appended claims.

Figure 1:
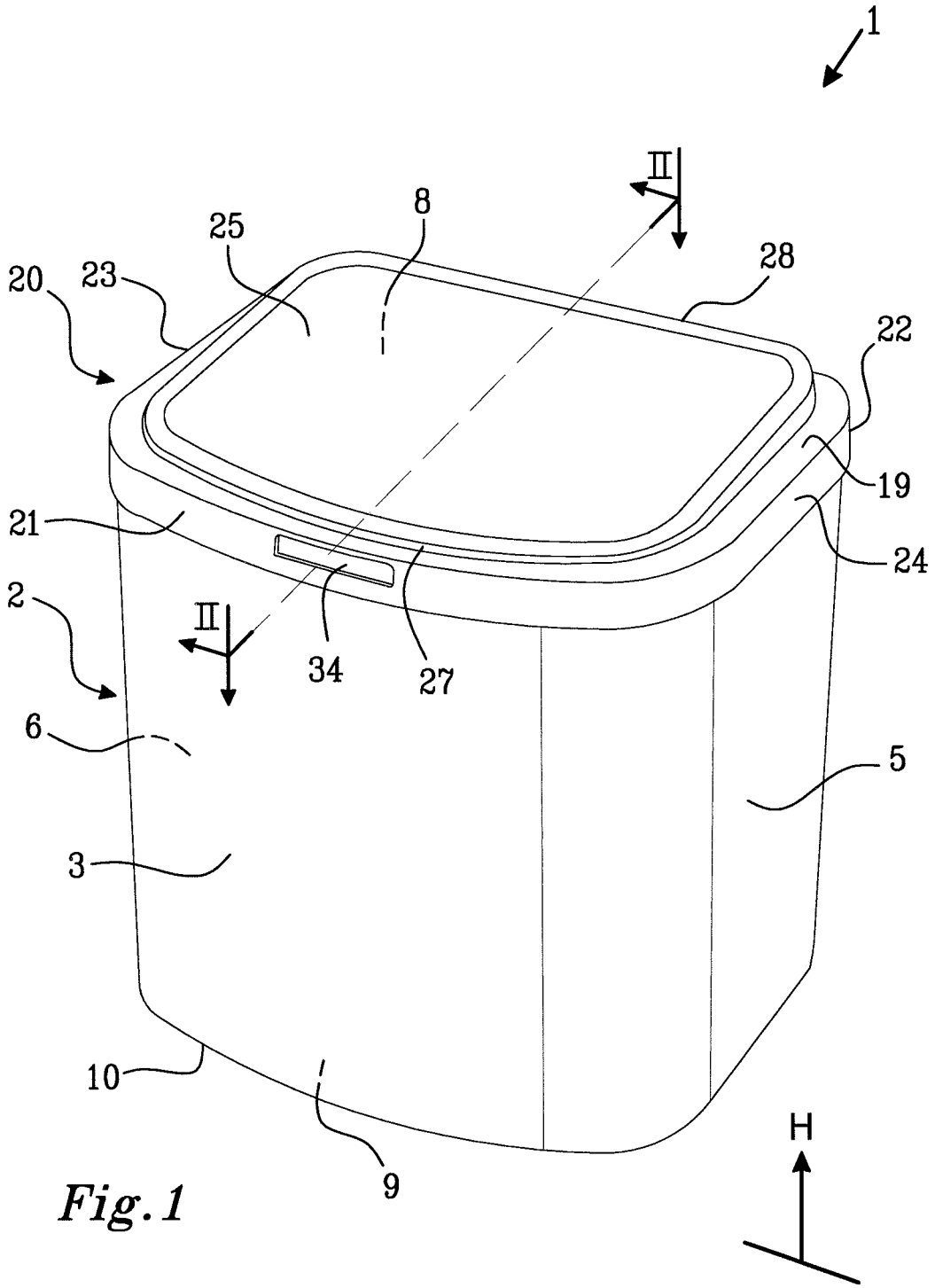
FIG. 1 shows a packaging container according to the invention.

With reference to FIGS. 1 and 2 there is shown a generally cuboid packaging container 1 for pourable or scoopable bulk solids. The particular shape of the container 1 shown in FIGS. 1 and 2 should not be considered limiting to the invention. The packaging container may preferably be a paperboard container, as defined herein.

The packaging container 1 comprises a container body 2 formed by a container wall including a front wall portion 3, a rear wall portion 4 and two side wall portions 5,6. The container wall portions 3, 4, 5, 6 extend from a container bottom 7 to a container opening 8 in a height direction H of the packaging container 1 and are of equal height h as measured from the container bottom 7 to the container opening 8. A bottom plate 9 is positioned at the bottom 7 of the packaging container 1. The container body may be a paperboard container body, as set out herein. The bottom plate 9 may be made from paperboard, metal, plastic, or from any suitable combination of such materials as known in the art. A bottom edge extends downward in the height direction from the bottom plate 9 whereby a downwardly open space is created between the bottom plate 9 and the bottom edge 10. The bottom edge 10 may be a rolled edge as shown in FIG. 2, or may be provided by a simple, non-rolled join between the bottom plate 9 and the container body 2. Furthermore, the bottom plate may be integrally formed with the container body by folding of an end portion of the container body material.

The container body 2 has an opening edge 11 at the container opening 8. The opening 8 and the opening edge 11 extend in a plane which is perpendicular to the height direction H of the packaging container 1. The opening edge 11 extends around the opening 8 and is formed by upper end edge portions of the container wall portions 3, 4, 5, 6 and includes a front opening edge portion 13, a rear opening edge portion 14 and two side opening edge portions 15, 16 as indicated in FIG. 3.

Figure 4:
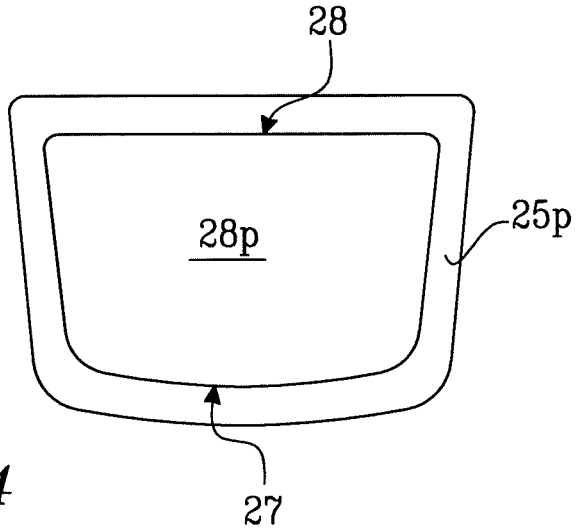
FIG. 4 shows a view of the lid of the packaging container in FIGS. 1 and 2 as seen in a direction perpendicular to the plane of the container opening.

The packaging container 1 comprises a lid 20 for closing the container opening 8. The lid has a front lid edge 21 which is adapted to be positioned at the front opening edge 13 of the container opening 8 and a rear lid edge 22 which is adapted to be positioned at the rear opening edge 14 of the container opening 8, two side lid edges 23,24 being adapted to be positioned at the corresponding side opening edges 15,16 of the container opening 8 and an upper outer lid surface 25 being delimited by the lid edges 21,22,23,24. The upper outer lid surface 25 comprises a slanted lid surface 26. The upper outer lid surface 25 and the slanted lid surface 26 each has a projected surface 25*p*, 26*p* in the plane of the opening 8, as illustrated in FIG. 4. The projected surface 25*p* of the upper outer lid surface 25 includes the projected surface 26*p* of the slanted lid surface 26*p* and the projected surface 26*p* of the slanted lid surface 26 constitutes 40%-100% of the projected surface 25*p* of the upper outer lid surface 25, such as from 50% to 90% of the projected surface 25*p* of the upper outer lid surface 25. It may be preferred that the projected surface 26*p* of the slanted lid surface 26 constitutes a major portion of the projected surface 25*p* of the upper outer lid surface 25 such as from 60% to 80% of the projected surface 25*p* of the upper outer lid surface 25 or 65% to 75% of the projected surface 25*p* of the upper outer lid surface 25. The slanted lid surface 26 is slanted such that when the lid 20 is in a closed position at the container opening 8, the front end edge 27 of the slanted lid surface 26 is located below the rear end edge 28 of the slanted lid surface 26 in the height direction H of the packaging container 1.

The packaging container 1 shown in FIGS. 1 and 2 may be stacked on another such packaging container 1 by resting the rolled bottom edge 10 on the portions of the upper outer surface 25 forming a ledge 19 surrounding the slanted lid surface 26, the rolled bottom edge 10 and the ledge 19 thus forming mating stacking members. As can be seen in FIG. 1, the portion of the lid 20 on which the slanted lid surface 26 is found forms a protrusion from the plane in which the ledge 19 is arranged, which plane may be considered to be a base plane for the lid 20. When one packaging container 1 is stacked upon another identical packaging container, the protruding slanted portion of the lid 20 is fully accommodated in the space defined by the bottom plate 9 and the downwardly extending bottom edge 10. Accordingly, the packaging containers can be safely stacked on top of each other in a stable and horizontal arrangement, despite the profiled, slanted shape of the lids 20.

Figure 2B:
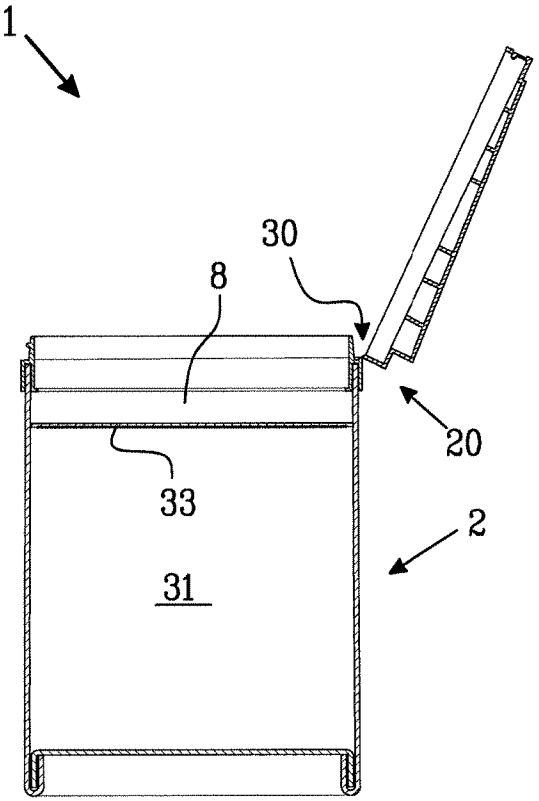
FIG. 2*a*-2*b* show a cross-section of the packaging container in FIG. 1 taken along the line II-II.
Figure 2A:
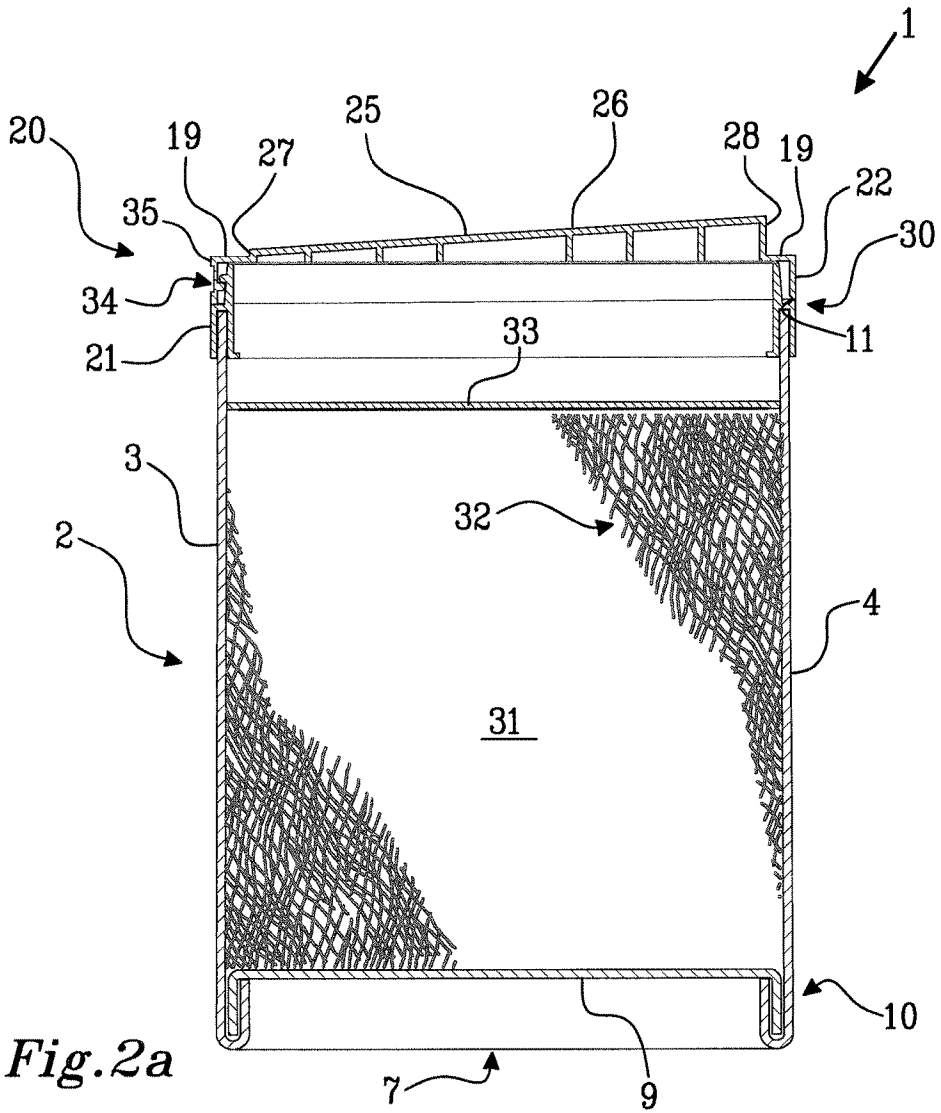
Figure 8:
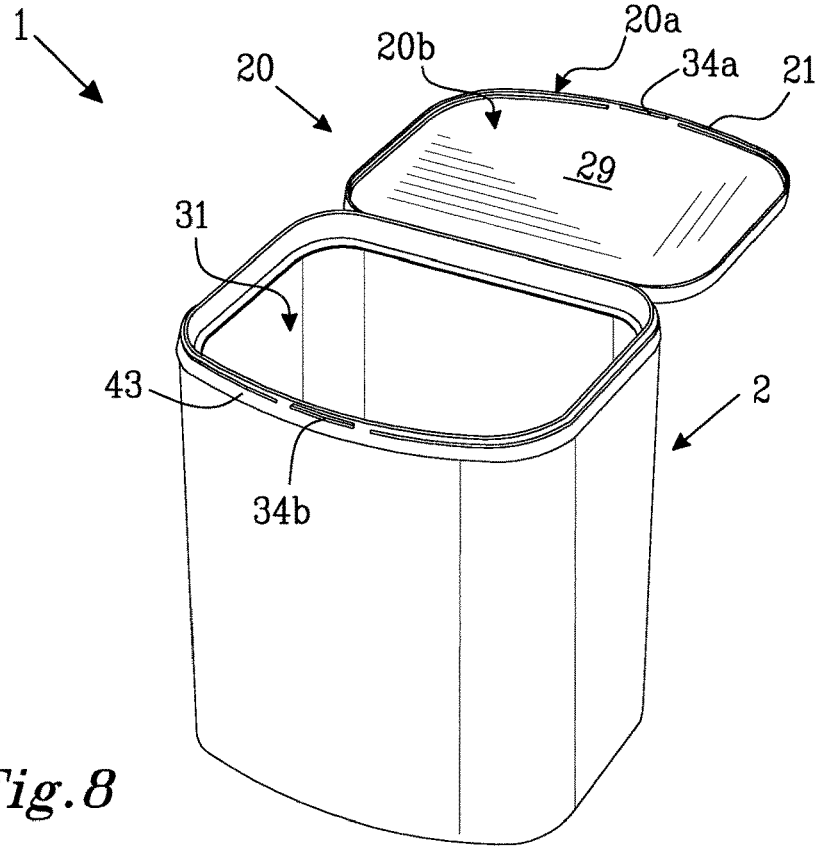
FIG. 8 shows the packaging container in FIGS. 1 and 2*a*-*b* with the lid in an open configuration.

The lid 20 is connected to the container body 2 with a hinge 30 arranged at the rear lid edge 22 of the lid. The hinge permits the lid 20 to be moved between the closed position as shown in FIGS. 1 and 2*a* an open position as shown in FIGS. 8 and 2*b*. As set out herein, a hinged connection between the container body and the lid is optional to the invention. Accordingly, the lid may alternatively be made without a hinge as a separate and completely removable part of the packaging container 1. The hinge may be a live hinge or a two-part hinge, as disclosed herein.

The container body 1 has an interior compartment 31 which is shown in FIG. 2*a* to contain packaged bulk material 32. The interior compartment 31 in FIG. 2*a* is sealed with a fully or partly removable protective membrane 33 which is applied over the packaged goods and which is sealed to the walls 3-6 of the container body 2. In order to gain a first access to the packaged goods, a user needs to swing back the lid 20 to the open position and expose the packaged goods 32 by fully or partly removing the protective membrane 33. The protective membrane may be arranged to be peeled away from the walls of the container body 2 or may be arranged with means for breaking the membrane so that it can be at least partly removed from the opening. The protective membrane 33 is an optional feature of the disclosed packaging container 1 and may be omitted.

Once the protective membrane 33 has been removed, it is sufficient to open the lid 20 in order to gain access to the bulk goods in the interior compartment 31.

When the packaging container 1 is open, a desired quantity of the packaged goods 32 may be removed from the packaging container 1 through the opening 8 either by hand, by using a scoop or a spoon, or by pouring.

Figure 9:
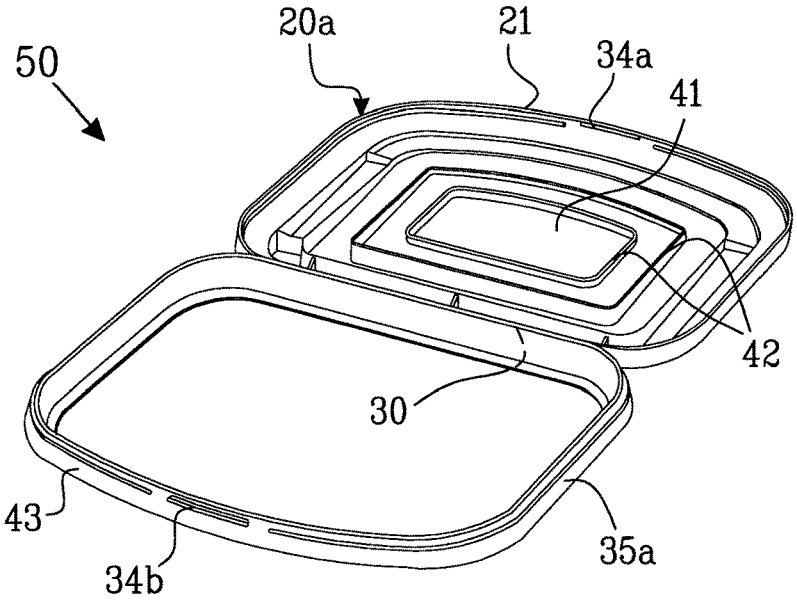
FIG. 9 shows a lid component comprising a lid portion and a rim portion.

In order to keep the lid 20 in the closed position during the time between dispensing occasions, the packaging container 1 may be provided with a locking arrangement 34. The locking arrangement 34 may comprise mating locking elements 34*a*, 34*b*, as illustrated in FIG. 9. The locking elements may be arranged on the lid 20 and on the container body 2 or, as shown in FIGS. 2, 8 and 9, on the lid 20 and on a rim 35 which is attached to the container body at the opening edge 11.

Figure 3A:
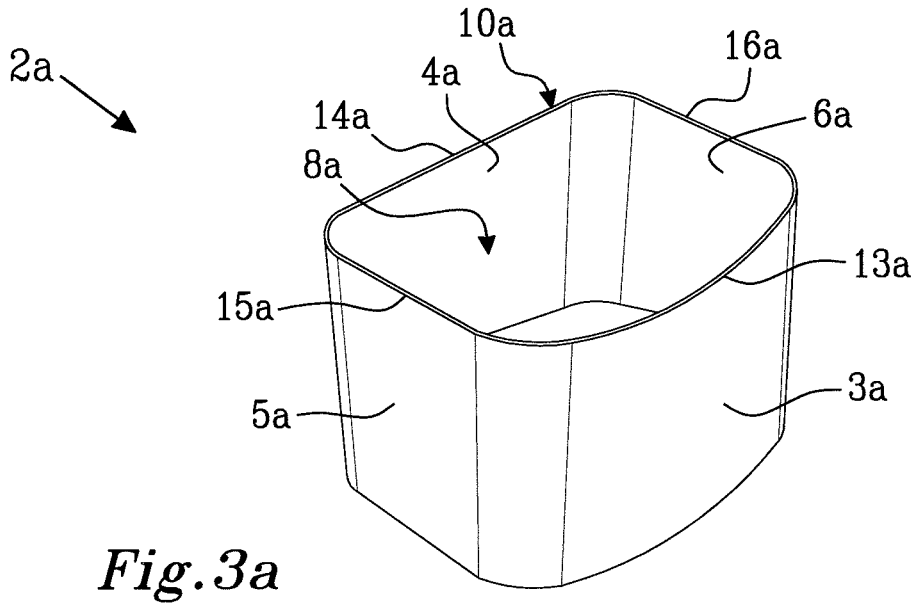
FIG. 3*a*-3*c* show examples of container body shapes.
Figure 3B:
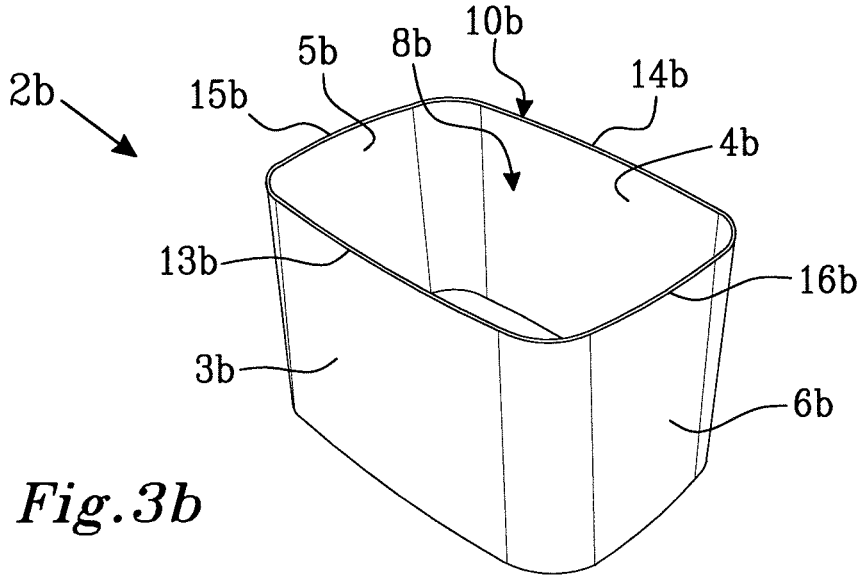
Figure 3C:
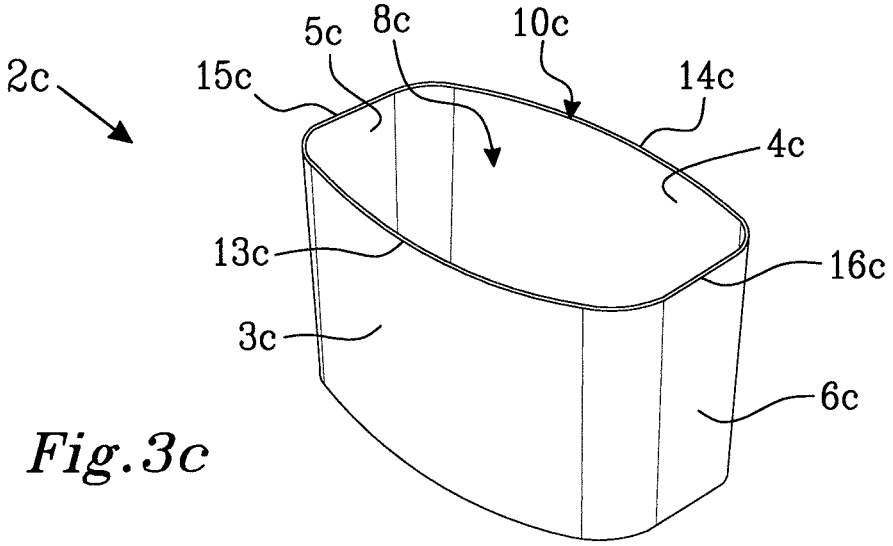

As is shown in FIGS. 3*a*-3*c*, the container body of the packaging containers according to the invention may have any useful shape as long as it has a front wall portion, a rear wall portion and two side wall portions. FIG. 3*a* shows a container body 2*a* having a generally D-shaped footprint with an outwardly curved front wall portion 3*a*, curved corners, planar side wall portions 5*a*, 6*a* and a planar rear wall portion 4*a*. This is the same shape as the shape of the container body 2 in FIGS. 1 and 2.

The container body 2*b* in FIG. 3*b* has curved corners and planar side wall portions 5*b*, 6*b* as well as a planar front wall portion 3*b* and a planar rear wall portion 4*b*.

The container body 2*c* in FIG. 3*c* has curved corners, curved front and rear wall portions 3*c*, 4*c* and planar side wall portions 5*c*, 6*c*.

Figure 5:
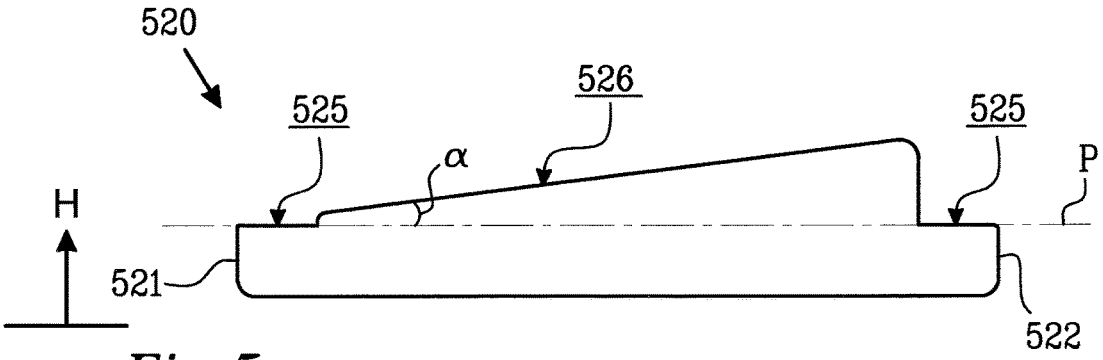
FIG. 5 shows a side view of a wedge-shaped lid.

FIG. 5 shows a side view of a wedge-shaped lid 520 according to the invention and illustrates how the slant angle $\alpha$ is measured as the angle between the slanted lid surface 526 on the upper outer lid surface 525 and a plane P which is parallel to the plane of the container opening over which the lid 520 is to be fitted, which is also a plane perpendicular to the height direction H of a packaging container as disclosed herein.

The lid in FIG. 5 is shown schematically without any optional components, such as a connection/hinge at the rear end 522 of the lid or a locking arrangement/locking element at the front end 521 of the lid 520.

Figure 6:
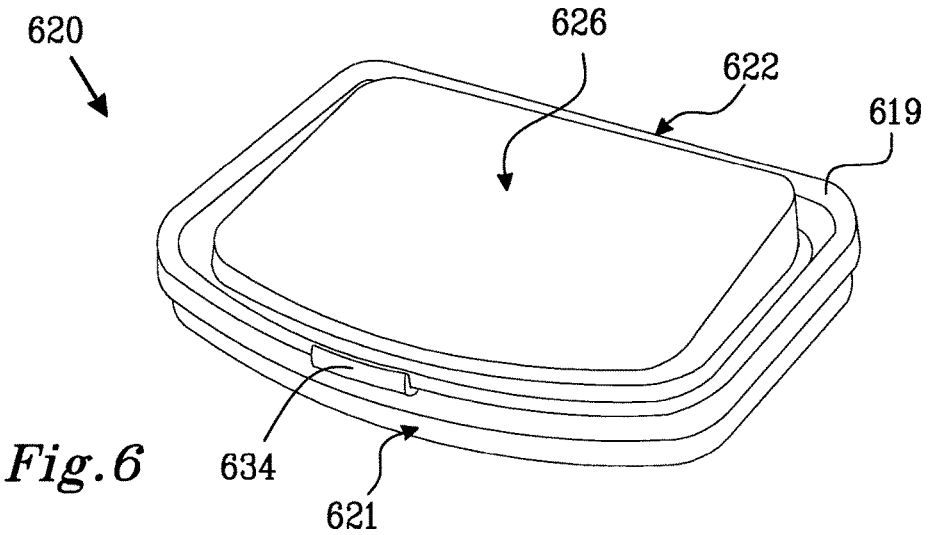
FIG. 6 shows a lid for a packaging container according to the invention.
Figure 7:
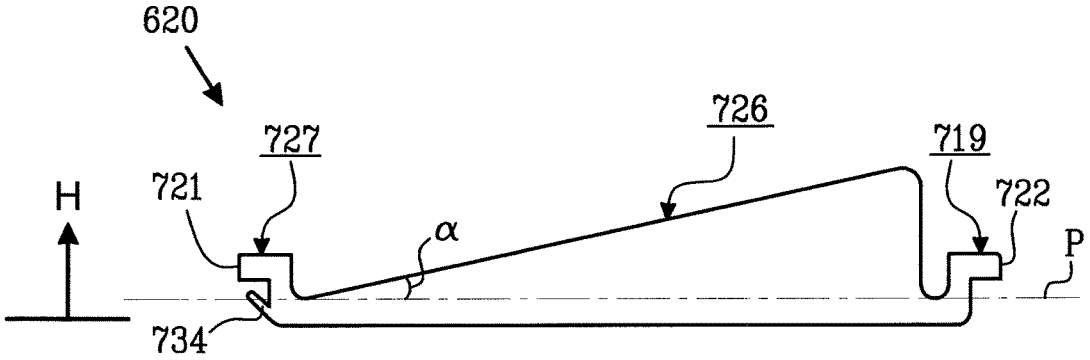
FIG. 7 shows a schematic cross-sectional view of a variant of the lid in FIG. 6.

FIGS. 6 and 7 show further embodiments of a lid according to the invention. In FIG. 6, the portion of the lid 620 on which the slanted lid surface 626 is arranged is shown to be surrounded by a groove and a ledge 619. Again, the slant angle $\alpha$ is measured as the angle between the slanted lid surface 626 on the upper outer lid surface 625 and a plane P which is parallel to the plane of the container opening over which the lid is to be fitted, which is also a plane perpendicular to the height direction H of a packaging container as disclosed herein.

FIG. 7 shows schematically a variation of the FIG. 6 lid, wherein the slanted lid surface 726 is partly sunken below the plane of the surrounding ledge 719.

The lids in FIGS. 6 and 7 are shown schematically without an optional connection/hinge at the rear end 622, 722 of the lid but with a locking arrangement/locking element 634, 734 at the front end 621, 721 of the lid 620, 720.

FIG. 8 shows the packaging container 1 in FIGS. 1 and 2 with the lid 20 in an open position, revealing the inner lid surface 29 and the interior compartment 31. The packaging container 1 in FIG. 8 is shown without an inner sealing membrane or packaged contents.

The inner lid surface 29 is shown to be planar and when the lid 20 is in the closed position as shown in FIGS. 1 and 2, the inner lid surface 29 is arranged parallel to the plane of the container opening 8. The lid 20 as shown in FIG. 8 is formed from an outer lid part 20*a* and an inner lid part 20*b*. The outer lid part 20*a* is a profiled part with a three-dimensional shape providing the upper outer surface 25 of the lid as well as the slanted lid surface 26. As is seen in FIG. 9, the outer lid part 20*a* has an inner surface 41 comprising a pattern of reinforcing ridges 42. The inner lid part 20*b* is shown to be a planar disk.

The two lid parts 20*a*, 20*b* are mechanically attached to each other by the inner lid part 20*b* being snapped into a groove extending along the edge of the outer lid part 20*a*, on the inner surface thereof. The inner lid part 20*b* may be formed from any suitable material, such as paperboard, plastic, laminated paperboard, etc.

FIG. 9 shows a lid component 50 comprising an outer lid part 20*a* comprising an outer lid surface including a slanted surface, and a rim part 35*a* which are connected by a hinge 30. The hinge 30 may be a live hinge or a two-part hinge, as disclosed herein. The rim part 35*a* is adapted for attachment to the container body, and is sized and configured to fit around the opening edge 11 of the container body 2. The rim part 35*a* may be directly attached to the container body 2, or may be attached via an intermediate attachment rim arranged on the container body 2.

FIG. 9 also illustrates the locking arrangement 34 in FIG. 1 comprising a first locking element 34*a* at the front edge 21 of the outer lid part 20*a* and a second mating locking element 34*b* on the front edge 43 of the rim part 35*a*.

A lid for the packaging container as disclosed herein, upper and lower reinforcement rims, lid components, etc. may be formed from thermo-formable or moldable plastic materials, e.g. by injection molding. Injection molding is particularly suitable for producing plastic components having a three-dimensional structure, such as the lid component 50 shown in FIG. 9.

It should be understood that the lid construction shown in FIGS. 8 and 9 is optional to the packaging container of the claimed invention. In particular, a lid for the packaging containers as disclosed herein may be made without an inner reinforcing framework, may be made as a single part, may be integrally formed with a plastic rim and a hinge, as shown in FIG. 9 or may be formed as a separate part which may be provide with a hinge element for creating a hinged connection to a container body or to a separate rim attached to a container body.

It is also to be understood that the shape of the lid may be different from that shown in the figures as long as the lid has the required outer slanted surface. As set out herein, the lid will generally have a contour which is adapted to the contour of the container opening, so as to create a good fit between the lid and the container opening. Moreover, the slanted surface may have a contour which is different from the contour of the lid. By way of example, the slanted surface may be oval, square, rectangular, etc. Furthermore, the slanted surface may be offset from a central position on the upper outer surface of the lid. The slanted surface may protrude from a base surface, as shown in FIGS. 1, 2, 5 and 8 or may be partly sunken below a base surface, as shown in FIG. 7.

The invention claimed is:

1. A packaging container for bulk solids, said packaging container comprising:

a container body formed by a container wall comprising a front wall portion, a rear wall portion, and two side wall portions, said container wall extending from a container bottom to a container opening in a height direction of said container and having a height as measured from said container bottom to said container opening, said container body having an opening edge at said container opening, said opening and said opening edge extending in a plane which is perpendicular to said height direction of said container; and a lid for closing said container opening, said lid having a front lid edge which is adapted to be positioned at a front edge portion of said container opening and a rear lid edge which is adapted to be positioned at a rear edge portion of said container opening, two side lid edges which are adapted to be positioned at corresponding side edge portions of said container opening and an upper outer lid surface being delimited by said lid edges, wherein said lid is wedge-shaped and has an inner lid surface which is parallel to said plane of said opening edge, wherein said upper outer lid surface comprises a slanted lid surface, said upper outer lid surface and said slanted lid surface each having a projected surface in said plane of said opening and said projected surface of said slanted lid surface constituting from 40% to 100% of said projected surface of said upper outer lid surface, such as from 50% to 90% of said projected surface of said upper outer lid surface, or from 60% to 80% of said projected surface of said upper outer lid surface, said slanted lid surface being slanted such that when said lid is in a closed position at said container opening, a front end edge of said slanted lid surface is located lower in said height direction of said container than a rear end edge of said slanted lid surface, and wherein said container comprises mating stacking members for allowing two or more of said packaging container to be arranged in a stacked configuration, said mating stacking members being arranged at said container bottom and at said container opening.

2. The packaging container according to claim 1, wherein said mating stacking members at said container opening comprise a continuous or discontinuous ledge which surrounds said slanted lid surface, and corresponding stacking members at the bottom of said packaging container comprise a bottom edge extending downward in said height direction from a container bottom plate, a height of said bottom edge being adapted to a maximum height of said slanted lid surface above said continuous or discontinuous ledge whereby any portion of said slanted lid surface which protrudes upwards in said height direction from said continuous or discontinuous ledge can be accommodated in a space created between said downwardly extending bottom edge and said container bottom plate.

3. The packaging container according to claim 1, wherein said slanted lid surface is a planar surface.

4. The packaging container according to claim 1, wherein said slanted lid surface is arranged at a slant angle (a) to said plane of said opening of from 2° to 25°, such as from 3° to 20°, from 4° to 15° or from 5° to 10°.

5. The packaging container according to claim 1, wherein said lid comprises an outer lid part and an inner lid part, said outer lid surface and said slanted lid surface being provided in said outer lid part.

6. The packaging container according to claim 1, wherein said front wall is outwardly curved and said container body has a generally D-shaped cross-section.

7. The packaging container according to claim 1, wherein said container is a paperboard container.

8. The packaging container according to claim 1, wherein said container is a gastight container and comprises an inner peelable or openable sealing membrane forming a cross-sectional seal between an interior compartment in the container body and the container opening.

9. The packaging container according to claim 1, wherein an edge rim is applied to said opening edge of said container body.

10. The packaging container according to claim 9, wherein said lid is arranged to engage with said edge rim to form a closure on said container.

11. The packaging container according to claim 9, wherein said lid is attached by a hinge to said edge rim.

12. The packaging container according to claim 11, wherein said lid comprises a lid part and said edge rim comprises a rim part, said lid part and said rim part being connected by said hinge, wherein said lid part is a profiled part comprising said upper outer surface of said lid and said slanted lid surface said lid part and said rim part forming parts of a lid component.

13. The packaging container according to claim 1, wherein said container is a container for pulverulent or granulated food-stuff.

14. The packaging container according to claim 1, wherein said container is a container for tobacco.

15. A lid component for the packaging container according to claim 1, said lid component comprising a lid part and a rim part which are connected by a hinge, wherein said lid part is a profiled part comprising said upper outer surface of said lid and said slanted lid surface and wherein said rim part is adapted for attachment to said container body, and is sized and configured to fit around said opening edge of said container body.

16. The lid component according to claim 15, wherein said lid component is stackable and comprises a continuous or discontinuous peripheral ledge surrounding said slanted lid surface on a first outer side of said lid component which peripheral ledge is arranged to cooperate with one or more stacking members at the opposite inner side of said lid component.

* * * * *